US007631523B1

(12) United States Patent
Sosa

(10) Patent No.: US 7,631,523 B1
(45) Date of Patent: Dec. 15, 2009

(54) TRAILER-MOUNTED FORKLIFT LOCK

(76) Inventor: Jorge Sosa, 3906 Yucatan Pkwy., Cape Coral, FL (US) 33993

( * ) Notice: Subject to any disclaimer, the term of this patent is extended or adjusted under 35 U.S.C. 154(b) by 0 days.

(21) Appl. No.: 12/195,076

(22) Filed: Aug. 20, 2008

(51) Int. Cl.
*E05B 73/00* (2006.01)

(52) U.S. Cl. ..... 70/14; 70/18; 70/32; 70/34; 70/56; 70/58; 280/507

(58) Field of Classification Search ..... 70/14, 70/18, 32, 54–56, 232, 258, 34, 62, 227, 70/233–235; 410/2, 77, 80; 414/462, 467; 211/4, 5; 248/551–553; 280/507
See application file for complete search history.

(56) References Cited

U.S. PATENT DOCUMENTS

| | | | | | |
|---|---|---|---|---|---|
| 1,337,568 | A | * | 4/1920 | Shannon et al. | 70/18 |
| 1,370,364 | A | * | 3/1921 | Rodriguez | 70/18 |
| 1,503,210 | A | * | 7/1924 | Shannon | 70/18 |
| 3,678,717 | A | * | 7/1972 | Eaton | 70/232 |
| 3,757,549 | A | * | 9/1973 | Mullis, Jr. | 70/232 |
| 3,800,570 | A | * | 4/1974 | Kaplan | 70/18 |
| 3,830,085 | A | | 8/1974 | Gerlach | |
| 3,893,312 | A | * | 7/1975 | Johnson | 70/58 |
| 3,981,165 | A | * | 9/1976 | Wersinger | 70/232 |
| 4,037,438 | A | * | 7/1977 | Miller | 70/18 |
| 4,285,221 | A | * | 8/1981 | Atchisson | 70/416 |
| 4,329,860 | A | * | 5/1982 | Moberg | 70/164 |
| 4,407,146 | A | * | 10/1983 | Nielsen, Jr. | 70/232 |
| 4,419,872 | A | * | 12/1983 | Plifka | 70/18 |
| 4,458,510 | A | * | 7/1984 | Nielsen | 70/212 |
| 4,506,528 | A | | 3/1985 | Eberly | |
| 4,538,827 | A | * | 9/1985 | Plifka | 280/507 |
| 5,195,339 | A | * | 3/1993 | Nee et al. | 70/14 |
| 5,297,407 | A | * | 3/1994 | Tarr | 70/232 |
| 5,575,604 | A | | 11/1996 | Dubosh et al. | |
| 5,749,695 | A | | 5/1998 | Moffett et al. | |
| 5,794,462 | A | | 8/1998 | Steele et al. | |
| D414,675 | S | | 10/1999 | Niswanger | |
| 6,161,402 | A | * | 12/2000 | Moore | 70/14 |
| 6,925,842 | B1 | * | 8/2005 | Hillabush et al. | 70/14 |
| 7,107,799 | B1 | * | 9/2006 | Marley et al. | 70/14 |
| 7,117,700 | B2 | * | 10/2006 | Smith et al. | 70/225 |

* cited by examiner

*Primary Examiner*—Lloyd A Gall
(74) *Attorney, Agent, or Firm*—Kyle Fletcher

(57) ABSTRACT

The invention is a security locking device that secures a forklift while hitched to a commercial trailer. The invention includes a "U" shaped base member having a pin hole, a pin, and an attaching locking mechanism. The invention is designed so as to place the "U" shaped base member over the locking pin hole located on the trailer bed, insert the locking pin through both the pin hole of the "U" shaped base member and the locking pin hole of the trailer bed, and then place a locking mechanism onto the pin and "U" shaped base member. The components of the invention shall be made of a tool-grade steel or a metal of like strength-ness.

6 Claims, 7 Drawing Sheets

TRAILER-MOUNTED FORKLIFT LOCK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to a security locking device that secures a forklift while hitched to a commercial trailer.

B. Discussion of the Prior Art

As a preliminary note, it should be stated that there is an ample amount of prior art that deals with security devices. As will be discussed immediately below, no prior art discloses a security device that is designed to protect a forklift while hitched onto a commercial trailer.

The Eberly Patent (U.S. Pat. No. 4,506,528) discloses a security device for a padlock which prevents the shackle members from being cut by a bolt cutter or hacksaw. However, the security device of the Eberly Patent does not include a locking mechanism that enables the device to secure a forklift to a commercial trailer.

The Steele Patent et al. (U.S. Pat. No. 5,794,462) is directed to a locking device that operates primary as a disabling apparatus. However, the locking device of the Steele Patent is not designed for securing a forklift to a commercial trailer via a U-shaped housing having a locking pin that is secured in place by a lock.

The Gerlach Patent (U.S. Pat. No. 3,830,085) discloses a lock case which has a U-shaped structure. However, the lock case, more specifically the U-shaped structure of the Gerlach Patent is designed to circumferentially surround over part of the apparatus to be secured, as opposed to a locking pin and base wherein protruding legs extend over a separate area to be secured by the locking mechanism.

The Dubosh Patent (U.S. Pat. No. 5,575,604) discloses an apparatus and method for mounting a forklift to a trailer bed. However, the apparatus of the Dubosh Patent does not have an integrated or separate locking mechanism in order to prevent the theft of the forklift while hitched to a commercial trailer.

The Moffett et al. Patent (U.S. Pat. No. 5,749,695) discloses a universal forklift truck mounting frame which secures a forklift to the rear end of a trailer bed. However, the securing means of the mounting frame disclosed in the Moffett Patent is directed to securing the wheels of the forklift in place with respect to the rear end of a trailer bed, as opposed to a "U" shaped locking mechanism that attaches to and secures over the place upon which the forklift secures itself onto the commercial trailer bed.

The Niswanger Patent (U.S. Pat. No. Des. 414,675) illustrates a design for a kingpin lock having a u-shaped collar and lockable pin, which is not designed to secure a forklift to a commercial trailer bed.

While the above-described devices fulfill their respective and particular objects and requirements, they do not describe a forklift lock that provides for the advantages of the forklift lock. In this regard, the forklift lock departs from the conventional concepts and designs of the prior art.

In light of the prior art there is a need for a forklift lock comprising a "U" shaped base having an insertable pin and locking mechanism so as to secure a forklift to a commercial trailer.

SUMMARY OF THE INVENTION

The invention is a security locking device that secures a forklift while hitched to a commercial trailer. The invention includes a "U" shaped base member having a pin hole, a pin, and an attaching locking mechanism. The invention is designed so as to place the "U" shaped base member over the locking pin hole located on the trailer bed, insert the locking pin through both the pin hole of the "U" shaped base member and the locking pin hole of the trailer bed, and then place a locking mechanism onto the pin and "U" shaped base member. The components of the invention shall be made of a tool-grade steel or a metal of like strength-ness.

An object of the invention is to provide a forklift lock that secures a forklift to a trailer in order to prevent theft.

A further object of the invention is to provide a forklift lock that is easy to install and remove.

A further object of the invention is to provide a forklift lock that is durable and resistant against attempts to dismantle.

A further object of the invention is to provide a forklift lock that is a deterrent to would-be criminals.

A further object of the invention is to provide a forklift lock that is affordable.

These together with additional objects, features and advantages of the forklift lock will be readily apparent to those of ordinary skill in the art upon reading the following detailed description of presently preferred, but nonetheless illustrative, embodiments of the forklift lock when taken in conjunction with the accompanying drawings.

In this respect, before explaining the current embodiments of the forklift lock in detail, it is to be understood that the forklift lock is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the forklift lock. It is therefore important that the claims be regarded as including such equivalent construction insofar as they do not depart from the spirit and scope of the forklift lock. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
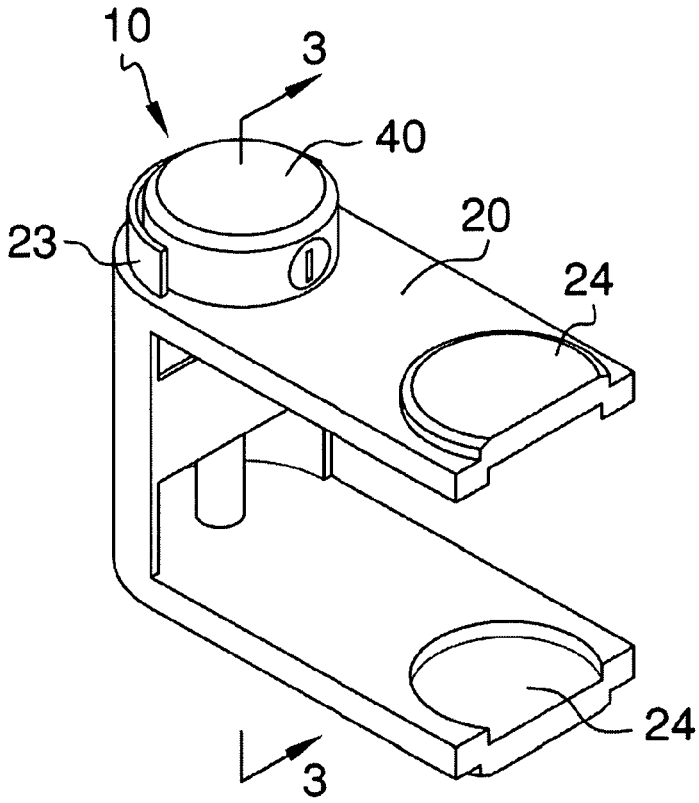
FIG. 1 illustrates a front, isometric view of the invention.
Figure 2:
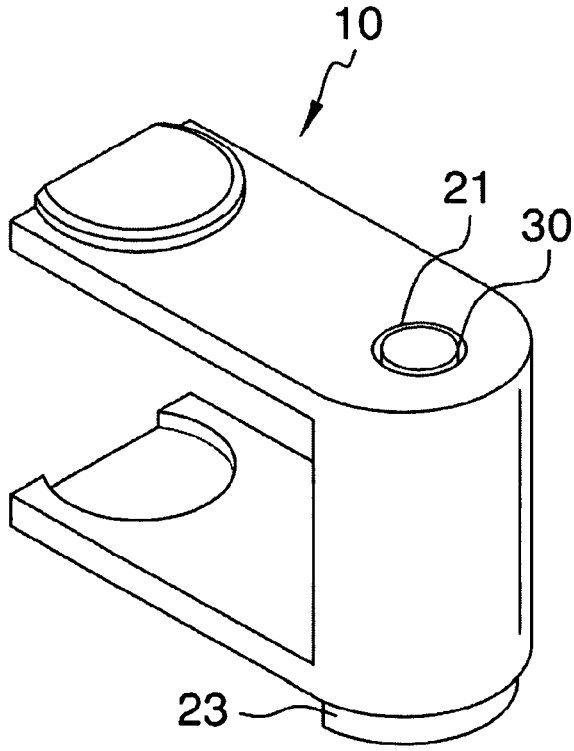
FIG. 2 illustrates a rear, isometric view of the invention.
Figure 3:
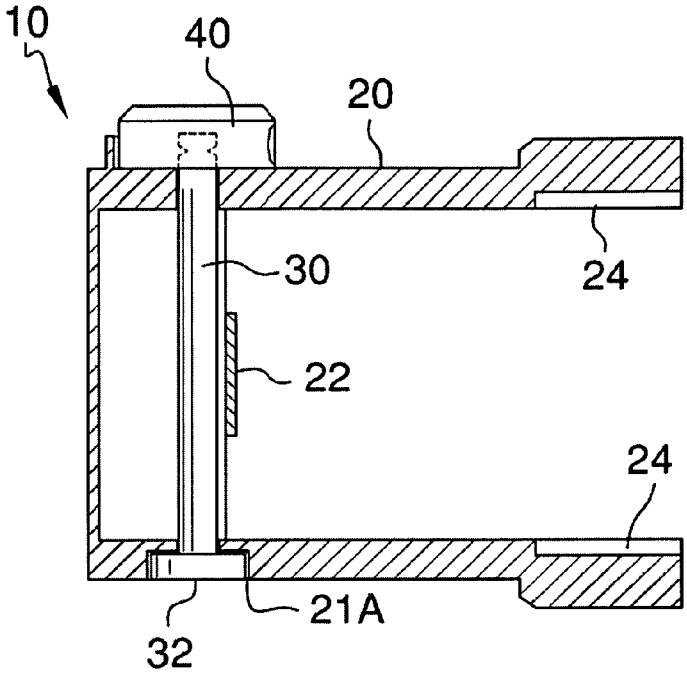
FIG. 3 illustrates a cross-sectional view of the apparatus along line 3-3.
Figure 4:
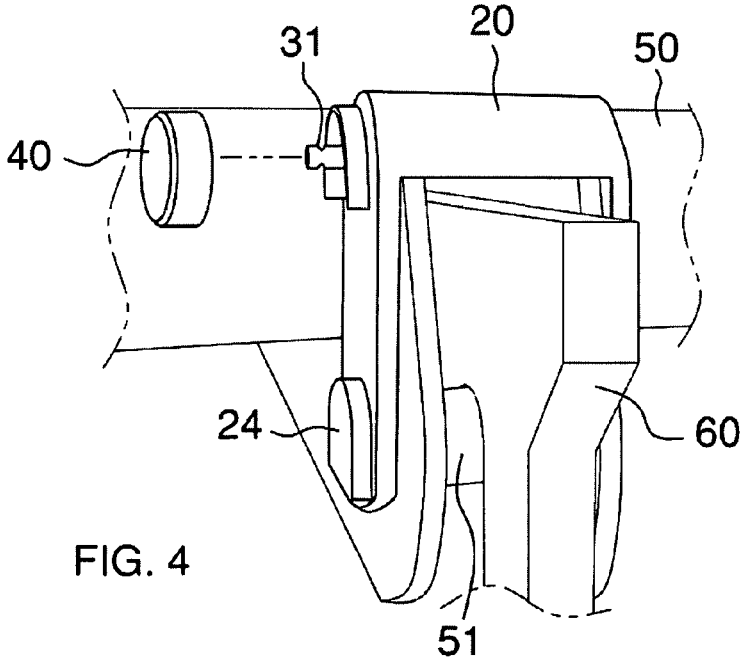
FIG. 4 illustrates a detailed, partially-exploded view of the invention in use.
Figure 5:
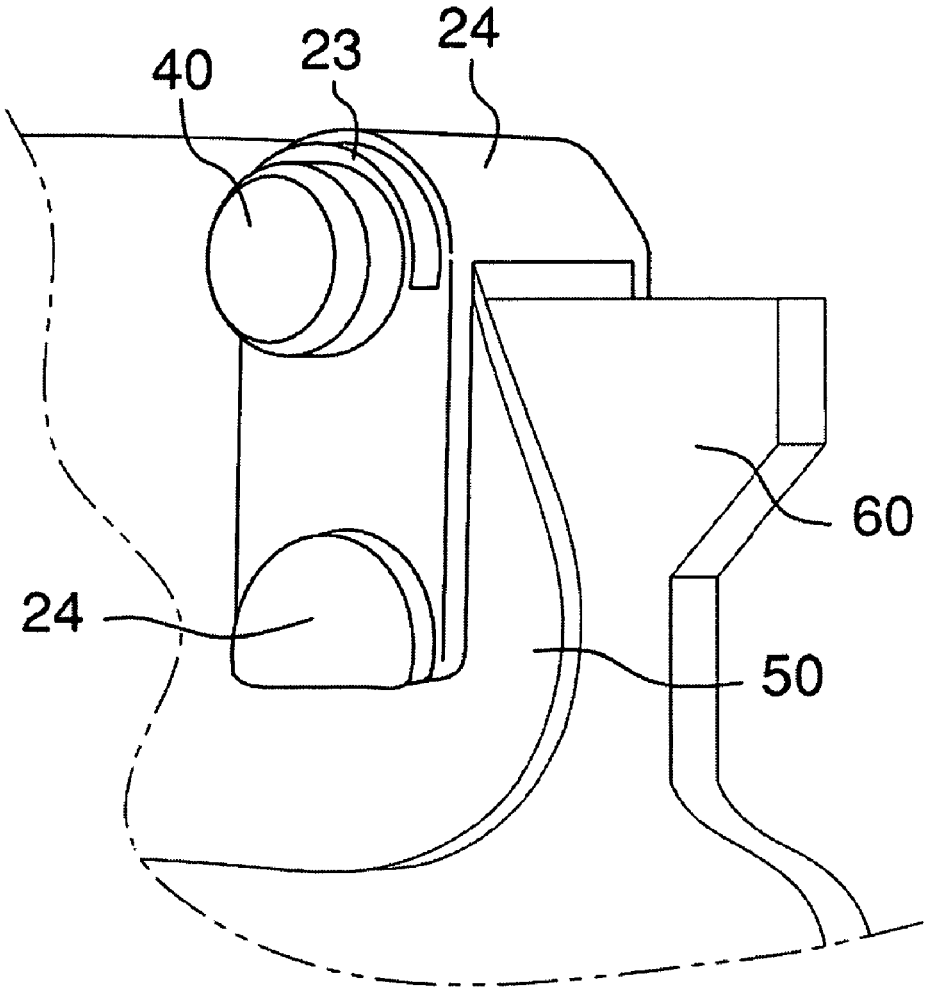
FIG. 5 illustrates an isometric view of the invention in use.
Figure 6:
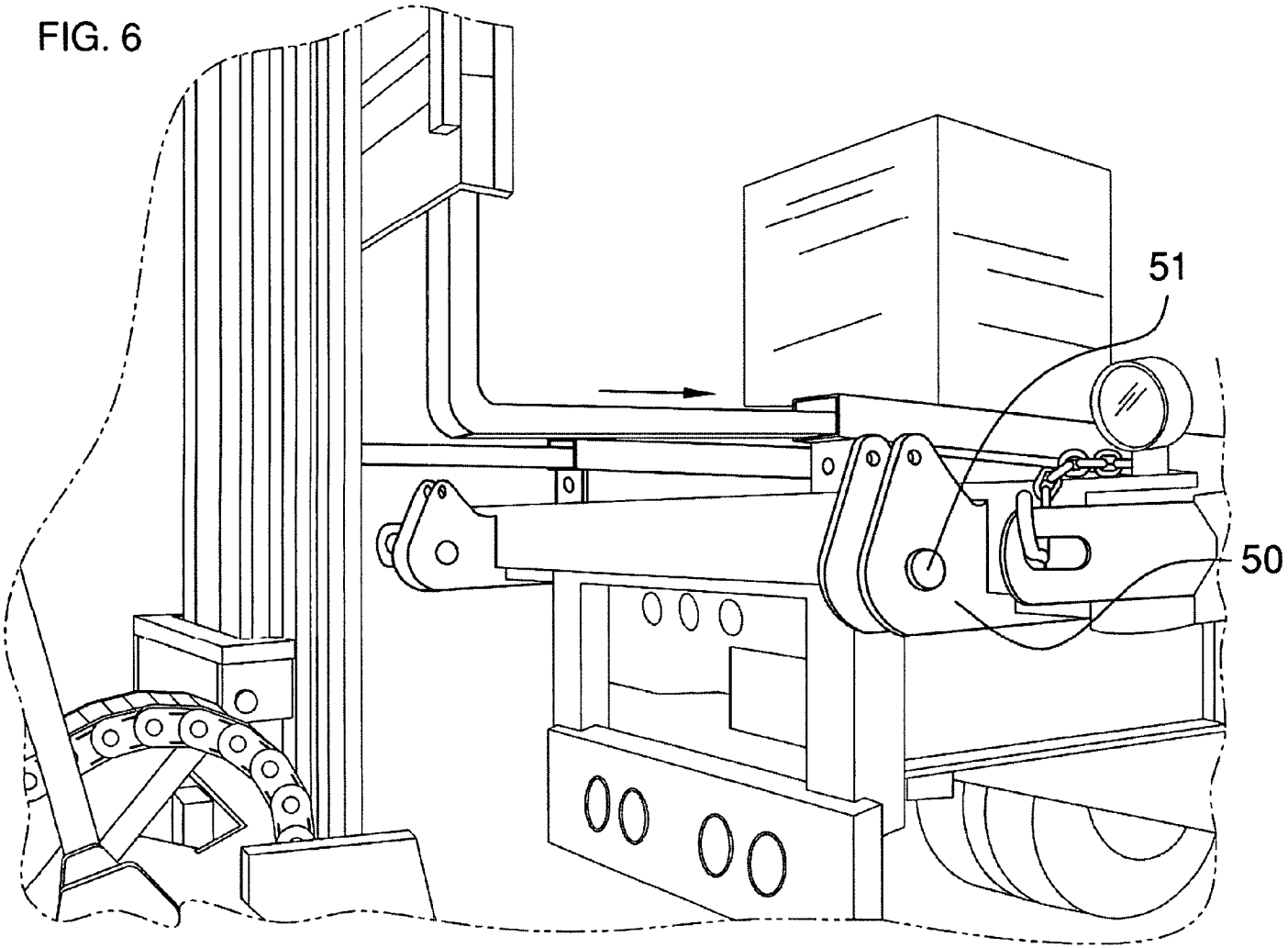
FIG. 6 illustrates the forks of a forklift being inserted into the rear openings of a trailer.
Figure 7:
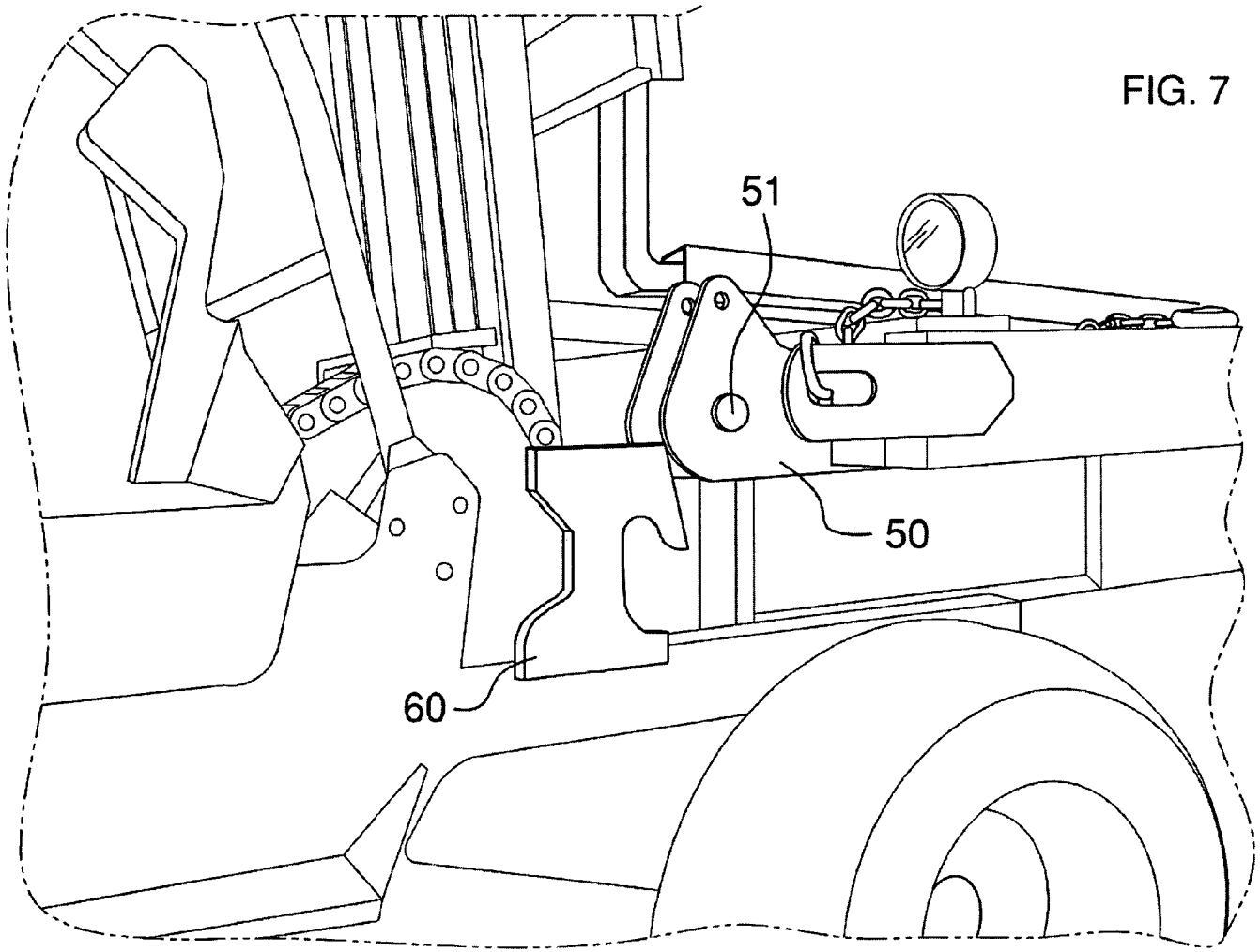
FIG. 7 illustrates the forklift raising up itself in alignment with the trailer bed support bracket.
Figure 8:
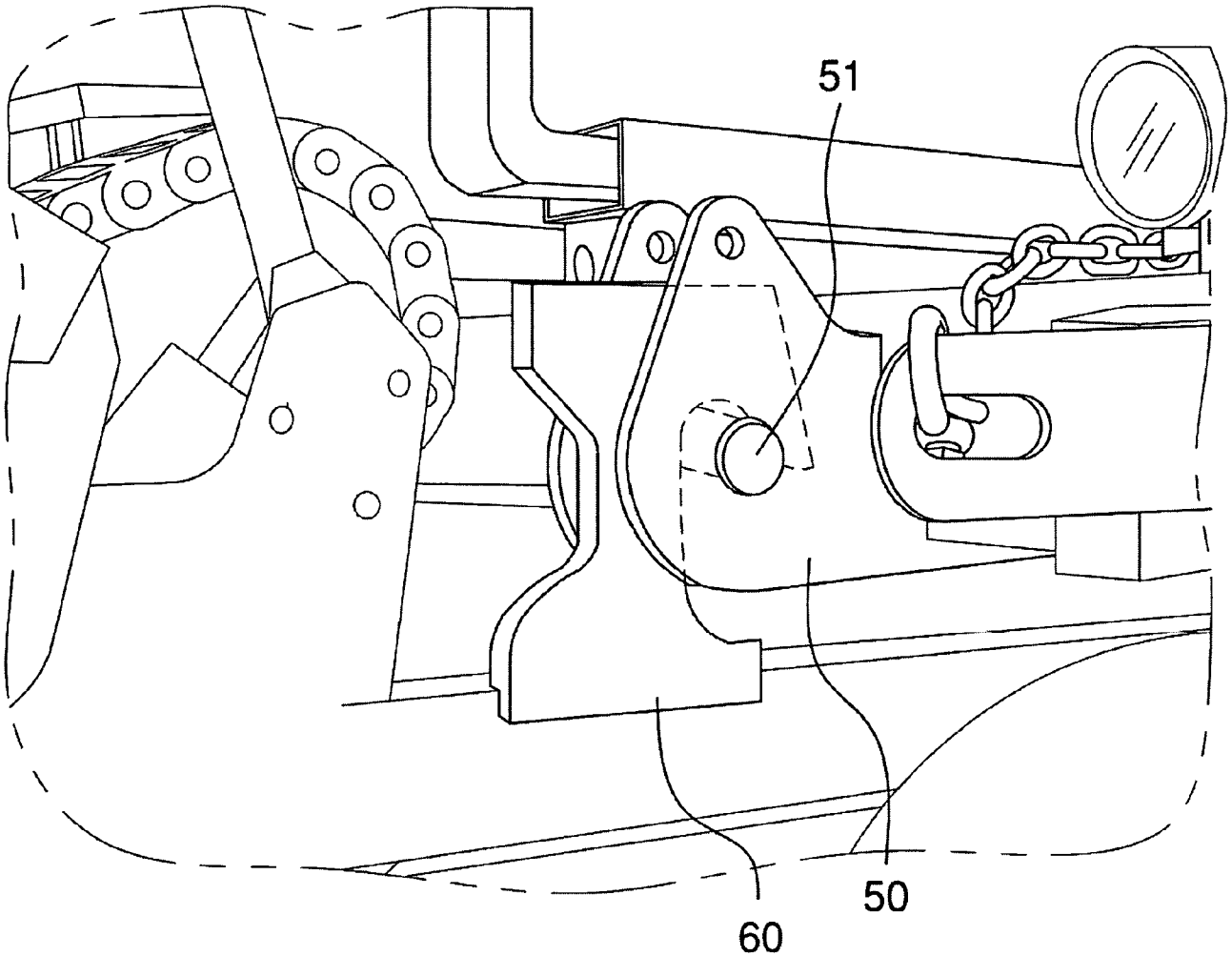
FIG. 8 illustrates the forklift positioned on the trailer bed support bracket with hidden lines indicating how the forklift rests upon the trailer bed support bracket.
Figure 9:
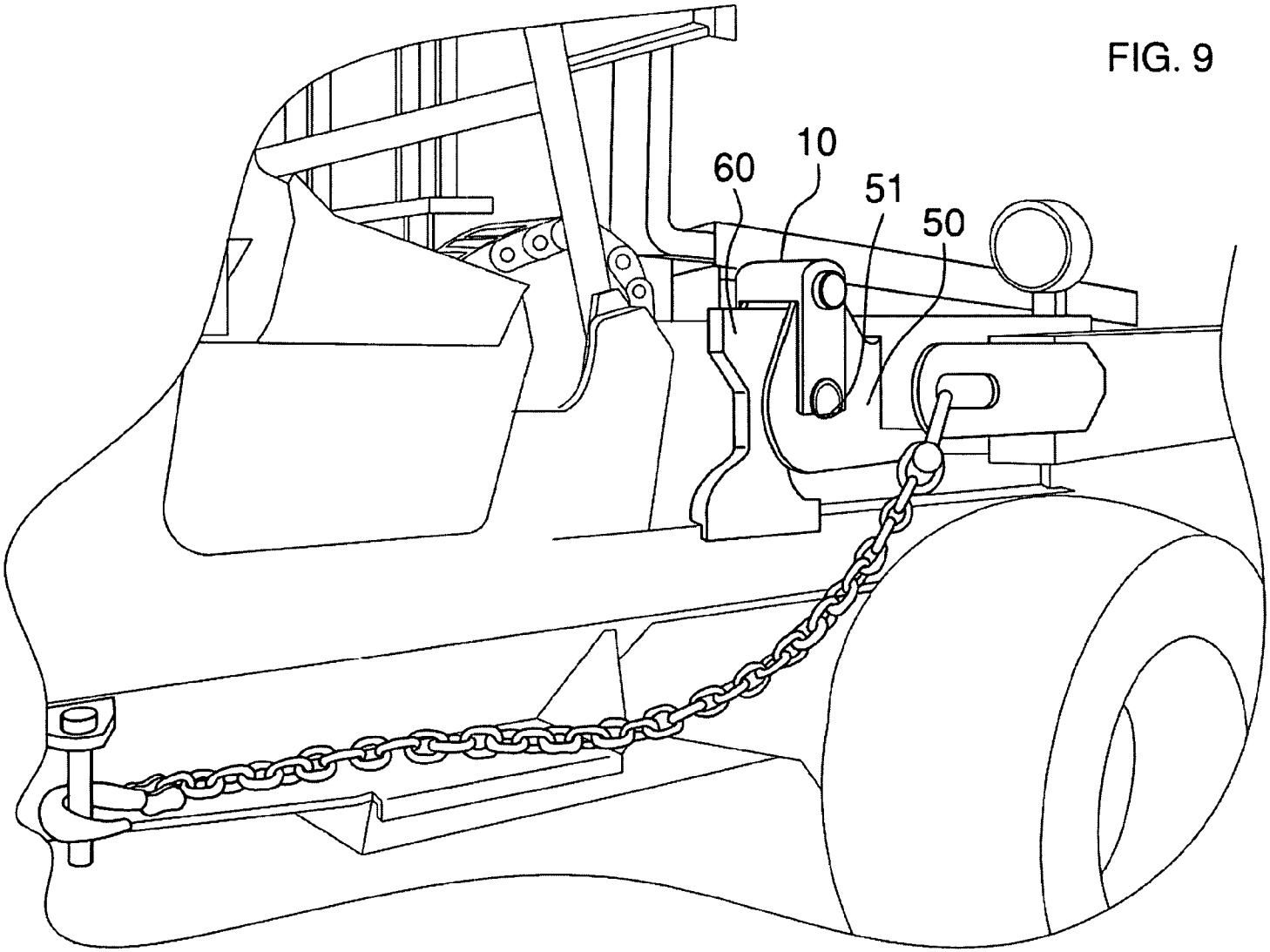
FIG. 9 illustrates the invention installed over the forklift and trailer bed mounting bracket.

Detailed reference will now be made to the present invention, examples of which are illustrated in FIGS. 1-9. A trailer mounted forklift apparatus 10 (hereinafter invention) 13 includes a "U" shaped base member 20, a locking pin 30, and a removable locking cap 40. The "U" shaped base member 20 shall have located near the bottom and at each side of the "U" a locking pin hole 21. Located along the interior, bottom of the "U" shaped base member 20 is a cover plate 22, which is designed to provide a minimal amount of coverage over the region of space that shall be occupied by the locking pin 30 when in place. Located to one side, and along the bottom exterior of the "U" shaped base member 20 is a locking cap cover 23.

Located along the interior surface at each of the two ends of the "U" are semi-circular recess cavities 24. The semi-circular recess cavities 24 are designed to protect and prevent removal of a pinion 51 that is permanently mounted to a commercial trailer bed 50, and for which a forklift 60 is capable of being hitched thereon.

Located at one end of the locking pin 30 is a notch 31, which enables the locking pin 30 to be securely locked to the removable locking cap 40.

Located at the opposite end of the locking pin 30 is a shoulder 32, which rests against a shoulder 21A located inside of the locking pin hole 21.

The invention 10 is used by placing the "U" shaped member 20 over the connecting place having a locking pin site on a commercial trailer bed where the forklift connects. Next, insert the locking pin 30 through the locking pin hole 21 of the "U" shaped base member. Next, lock the removable locking cap 40 over the notches 31 of the locking pin 30.

With the invention 10 in place, the pinion 51 is securely protected by both sides of the "U" shaped base member 20 from removal. Also, the invention 10 prevents the undesired removal of the forklift 60 by locking the pin hole 21 immediately above the pinion 51 of the trailer 50 thereby preventing egress of the forklift 60 from the trailer bed 50.

The "U" shaped base member 20, locking pin 30, and removable locking cap 40 shall be made from a tool grade steel or other hard metal.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

While the embodiments of the invention have been disclosed, certain modifications may be made by those skilled in the art to modify the invention without departing from the spirit of the invention.

The inventor claims:

1. A trailer-mounting forklift locking device comprising:

(a) A "U" shaped base member;

wherein sides of the "U" shaped base member each have a locking pin hole; ends of the sides including a cavity in an interior surface thereof for receiving a forklift mount;

(b) a locking pin; and wherein the locking pin has a first end that is capable of passing through the locking pin holes, and wherein said locking pin has a shoulder upon a second end that rests against a locking pin hole upon insertion of said locking pin into said locking pin holes;

(c) a removable locking cap;

wherein the locking cap is capable of locking upon said first end of the locking pin along an outer surface of said "U" shaped member adjacent one of said locking pin holes.

2. The trailer-mounting forklift locking device as described in claim 1 wherein a locking cap cover is provided along the exterior of the "U" shaped base member for protecting the removable locking cap.

3. The trailer-mounting forklift locking device as described in claim 1 wherein the "U" shaped base member, locking pin, and removable locking cap are made from a tool grade steel.

4. A trailer-mounting forklift locking device comprising:

a "U" shaped base member having a locking pin hole in sides of the "U" shaped base member;

a locking pin having a first end that is capable of passing through said locking pin holes, and wherein said locking pin has a shoulder upon a second end that rests against a locking pin hole upon insertion of said locking pin into said locking pin holes;

a removable locking cap is capable of locking upon said first end of said locking pin, and wherein said removable locking cap is placed along an exterior of a side of said "U" shaped member adjacent one of said locking pin holes;

cavities are integrated into interior surfaces of the sides of said "U" shaped base member to protect and prevent removal of a pinion located on a trailer bed whereby a forklift rests.

5. The trailer-mounting forklift locking device as described in claim 4 wherein a locking cap cover is provided along the exterior of the "U" shaped base member for protecting the removable locking cap.

6. The trailer-mounting forklift locking device as described in claim 4 wherein the "U" shaped base member, locking pin, and removable locking cap are made from a tool grade steel.

* * * * *